United States Patent [19]

Craig

[11] Patent Number: 4,658,894

[45] Date of Patent: Apr. 21, 1987

[54] WELL HEAD PIPE STRIPPER

[76] Inventor: Paul M. Craig, 30131 Matisse Dr., Rancho Palos Verdes, Calif. 90274

[21] Appl. No.: 746,649

[22] Filed: Jun. 20, 1985

[51] Int. Cl.[4] ..... E21B 33/08

[52] U.S. Cl. ..... 166/84; 166/177; 15/104.04; 277/24

[58] Field of Search ..... 166/84, 170, 173, 177; 15/104.04; 277/24, 205, 135

[56] References Cited

U.S. PATENT DOCUMENTS

| | | | |
|---|---|---|---|
| 582,638 | 5/1897 | Gibson | 166/177 X |
| 2,550,487 | 4/1951 | MacClatchie | 15/104.04 X |
| 3,052,300 | 9/1962 | Hampton | 166/84 |
| 3,128,614 | 4/1964 | Auer | 166/84 X |
| 3,965,987 | 6/1976 | Biffle | 166/84 X |
| 4,304,310 | 12/1981 | Garrett | 166/84 X |
| 4,312,404 | 1/1982 | Morrow | 166/84 |
| 4,363,357 | 12/1982 | Hunter | 166/84 |
| 4,456,062 | 6/1984 | Roche et al. | 166/84 |
| 4,531,591 | 7/1985 | Johnston | 166/84 X |

*Primary Examiner*—Stephen J. Novosad
*Assistant Examiner*—John F. Letchford
*Attorney, Agent, or Firm*—Wm. Jacquet Gribble

[57] ABSTRACT

A Pipe Guide Stripper Rubber stripper of modified Shaffer design has a resilient, molded frusto-conical stripper unit that mounts within a conventional standing compression shell supported on the drill or production platform. The molded stripper unit has an internal cavity with walls designed to strip sludge, mud and other grime from the pipe string periphery as the pipe is raised from the well bore, confining the muck to the well pit rather than having it fall to the work platform. A mounting plate is removably attached to the stripper unit by separable fasteners so that the plate may be recovered from a worn out molded stripper unit for further use without burning or abrading the stripper unit from the mounting plate.

4 Claims, 4 Drawing Figures

FIG. 1.
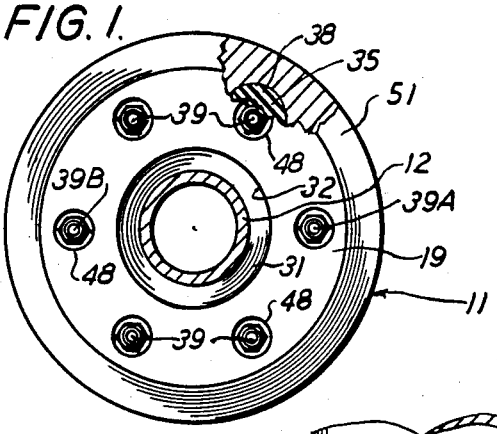
FIG. 2.
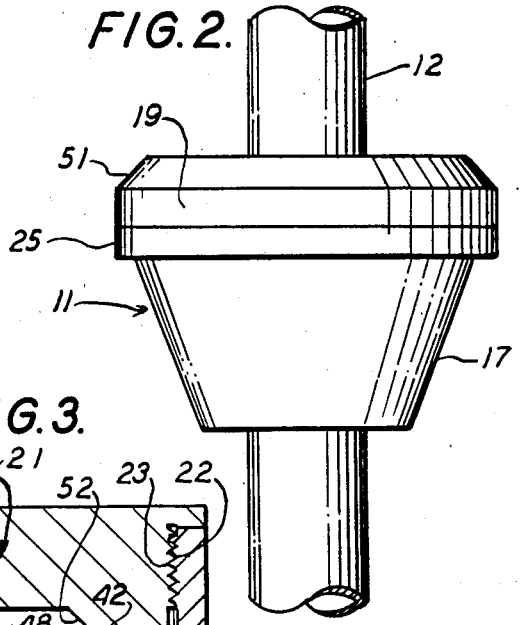
FIG. 3.
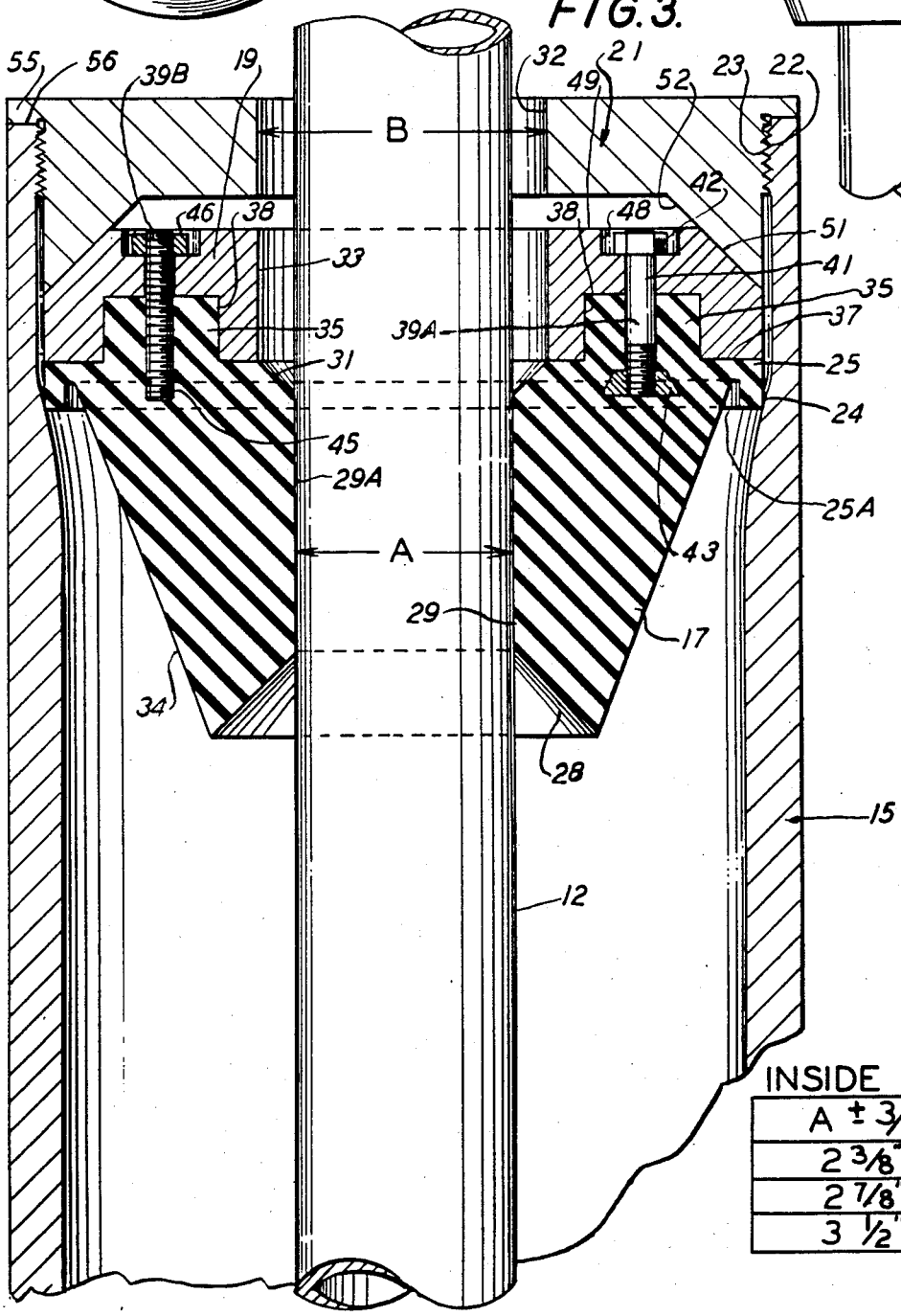
FIG. 4.
INSIDE DIAMETER
| A ± 3/16" | B |
|---|---|
| 2 3/8" | 4" |
| 2 7/8" | 4" |
| 3 1/2" | 4" |

WELL HEAD PIPE STRIPPER

BACKGROUND OF THE INVENTION

The invention relates to means for stripping sludge and mud from a pipe string being raised from a well bore and more particularly to strippers of the Pipe Guide Stripper Rubber type like the Shaffer device. Such strippers are conventionally molded of resilient material such as rubber or its synthetices and are mounted within a compression shell rising from the well platform. Part of the stripper assembly is a steel mounting plate which heretofore has been fixed to the stripper unit by having the latter molded upon it to form an integral unit. Therefore, when the molded stripper unit has deteriorated beyond further efficient use it has been burned or ground off the mounting plate to recover the plate for further use. Either process of separation has been objectionable because of the energy wasted in the process and because of harmful gases and undesirable particulate discharged into the atmosphere. While the salvage value of the mounting plate is high, the difficulties of removing the the molded unit from the plate have often resulted in wasteful discarding of the plates. The present invention provides a Pipe Guide Stripper Rubber Stripper wherein the molded stripper unit may easily be detached from the plate because it is secured by separable fasteners and a new molded unit secured to the plate in a short operation without burning or abrading the old resilient unit.

BRIEF STATEMENT OF THE INVENTION

A well pipe stripper for pipe strings supported from a production or drill rig to be enclosed in a compression shell fixed to the rig platform has a molded resilient stripper unit and a stripper mounting plate. Annular walls in the stripper unit define a stepped central bore adapted to contact the pipe periphery. A plurality of securing pads integral with the stripper unit extends from the upper surface of the unit to register in matching cavities in the under side of the plate. A fastening associated with each pad detachably secures between the unit and the plate, with each fastening having a segment molded into the stripper unit and a fastener head turnable by a wrench within a plate surface recess. The segment may be an externally threaded shank molded in the unit or an internally threaded retainer embedded in the unit below the unit top surface and accessible through a molded port.

The molded stripper unit has a lower inverted frusto-conical outer portion surrounding a central upright frusto-conical chamber that is coaxial with upper and lower central cylindrical walls defining a stepped passage for the pipe string, the conical chamber blending into the lower cylindrical passage. The stripper unit has an upper flange with a narrow downward lip defining an inner annulus that provides deformation capacity for the flange so that it may seal against the inner surface of the compression shell when plate and stripper unit are impinged by the clamping collar which is threadably engaged with the compression shell, in conventional fashion The Pipe Guide Stripper Rubber Stripper of the invention affords apparatus which is easily formed by conventional methods and machines from materials already available. The practice of the invention in employing the apparatus is within the comprehension of those who will employ it. The environment is spared noxious pollutants and salvage of the used mounting plates is simplified. These and other advantages of the invention are apparent from the following detailed description and drawing.

BRIEF DESCRIPTION OF THE DRAWING

FIG. 1 is a top plan view, partly broken away, of the stripper assembly of the invention;

FIG. 2 is an elevational view of the assembly of FIG. 1 in association with a pipe string;

FIG. 3 is a fragmentary sectional elevational view of the stripper assembly of FIG. 1 in place in a compression shell; and FIG. 4 is a dimensional table of the device of FIG. 3.

DESCRIPTION OF THE PREFERRED EMBODIMENTS

In FIGS. 1 through 3 a stripper assembly 11 is shown about a segment 12 of a pipe string which normally is supported by a rig (not shown) of a producing or drilling well. Associated with the rig is a platform, a hoist and a well pit, none of which are shown. Usually a compression shell like the shell 15 of FIG. 3 contains the stripper assembly, the shell rising vertically from the platform.

The stripper assembly comprises a resilient stripper unit 17 and a rigid metallic mounting plate 19. A clamping collar 21 with outer threads 22 is engaged in the internal threads 23 at the top of the compression shell, above the point of the shell inner wall where the inner shell diameter increases or where the shell wall thickness changes. In effect the diameter change forms a shoulder 24 against which a stripper unit flange 25 binds. The flange has a hollow annulus 25A which affords added resilience for the flange to enhance the bond between the shell wall and the stripper unit flange.

The stripper unit has a series of central cavities defined by a conical wall 28, a cylindrical wall 29 and an inverted frusto-conical wall 31. The cavities are coaxial and the intermediate cavity 29A will have differing diameters depending upon the diameter of the pipe for which it is intended. This dimension is indicated at "A" and tabulated in table of FIG. 4. Note that the I.D. may vary between 2.375 inches and 3.5 inches in the illustrative embodiment. Dimension "B" will be constant for stripper units in the size range illustrated which is designed to accommodate pipe sizes up to about 4 inches, in the cavity defined in the mounting plate.

The slope of the frusto-conical wall 28 is found to operate best when about 45°, while the slope of outer inverted cone wall 34 is optimum at about 22°. A synthetic rubber such as "Nitrila" or Buna-N has proved to be effective in stripping action for the configuration illustrated.

The stripper unit has a plurality of securing pads 35 projecting from upper surface 37. The pads are shown in the broken portion of FIG. 1 and in section in FIG. 3. Each pad seats or registers in a mounting plate cavity 38. A fastening 39 separably secures the stripper unit to the mounting plate at each securing pad to comprise the stripper assembly 11 within the compression shell 15. In the case of fastening 39A to the right in FIG. 3 the fastening comprises a bolt 41 with a wrenchable head 42 threadedly engaged with an internally threaded anchor 43 fixedly molded into the stripper unit 17.

On the other hand, fastening 39B at the left of FIG. 3 comprises an externally threaded stud 45 fixedly molded into stripper unit 17 and protruding above securing pad 35 to receive a nut 46. Both nut 46 and head 42 reside in shallow recesses 48 in the top surface 49 of mounting plate 19. Each recess is of sufficient diameter to accept a socket wrench to engage with the head or nut.

The mounting plate thus has lower recesses 38 to seat the securing pads 35 of the stripper unit 17 and upper recesses 48 to receive the fasteners 42 and 46. The diameter of the mounting plate is slightly less than the inside diameter of the compression shell 15 above shoulder 24 to permit clamping collar 21 to expand stripper unit flange 25 against the inner wall of the compression shell.

To impinge upon the mounting plate beveled surface 51, clamping collar 21 has a frusto-conical lower recess defined by annulus 52. The annulus surface bears upon the upper beveled surface of the mounting plate as the collar is screwed into engagement with the compression shell, the penetration of the collar being limited by a stop flange 55 extending over the shell end to contact that end 56.

To fabricate and use the stripper unit of the invention the unit is first molded in customary fashion from rubber, Buna- N or an equivalent substance. If a metal mold is used a mold draft of 5° is employed. Curing time in the mold is about one and one-half hours. The mounting plate may be of cast iron, ductile steel, aluminum or Kelvin fibers. It has been found that the fastenings may be made from $\frac{3}{8}'' \times 16$ N.F. threaded stock and the six fastenings shown are sufficient to resist the forces involved.

Since the bores 32 of the collar and 33 of the plate are not changed from pipe size to pipe size, both the collar and the plate may be re-used for all pipe within the illustrative range disclosed. The stripper unit 17 is easily removed from the mounting plate at the well site and can be replaced to adjust for a change in pipe size or to replace a worn stripper unit.

The stripper assembly is installed by first assembling the unit and the plate by means of the fastenings. Assembly may be at the factory or at the well head. The assembled stripper is then placed in the compression shell 15 with the flange 25 of the stripper unit resting upon shoulder 24 of the inner wall of the shell. The collar 21 is then threadably engaged with the shell and the collar turned down to achieve the desired union with the compression shell. The pipe string is preferably broken just above the compression shell so that the stripper assembly and compression collar may be slipped over the string element from the platform. In other instances the stripper unit may be in place when the string is lowered into the well.

When the pipe string and its accumulation of sludge, mud, oil and other grime is raised from the well the outer surface of the pipe is wiped by the frusto-conical surface 28 and the cylindrical surface 29, with the stripped material falling into the well pit instead of being carried above the well platform. Since the grime content is very abrasive, the ensuing wear on the resilient stripper unit is rapid, and the stripper unit life is short. However, due to the advantages offered by the invention the change to a new stripper unit can be rapid, shortening down time, and the 11 inch diameter mounting plate is salvagable without burning or abrading. The whole replacement procedure is within the grasp of an average worker and no special tools are needed.

While two differing fastening combinations have been shown, the scope of the invention should not be limited to these, or to the solely illustrative embodiments disclosed herein. It is desired that the invention be measured by the appended claims, since other modes within the scope of the invention will occur to those skilled in this particular art.

I claim:

1. A well pipe stripper for pipe strings supported from a drill or production ring and surrounded by a compression shell upon a rig platform, the combination comprising a frustro-conical stripper unit, coaxial annular walls defining a stepped central bore in the stripper unit adapted to contact the outer surface of the well pipe, a plurality of securing pads integral with said stripper unit and extending from the upper surface of said stripper unit, fastening means associated with each of said securing pads, a metallic mounting plate fitted to said stripper unit, fasteners accesible on said mounting plate for engagement with said fastening means to secure removably said stripper unit to said mounting plate, and clamping means for retaining said stripper unit and mounting plate in said compression shell about said well pipe.

2. Apparatus in accordance with claim 1 wherein said fastening means associated with each securing pad comprises an internally threaded member molded integrally in said stripper unit at each securing pad, said fasteners accessible on said mounting plate each comprising a headed, externally threaded member.

3. Apparatus in accordance with claim 1 wherein said fastening means associated with each securing pad comprises an externally threaded member molded integrally with said stripper unit at each securing pad, and said fasteners accesible on said mounting plate each comprises an internally threaded member with a wrenchable external periphery.

4. Apparatus in accordance with claim 1 wherein said mounting plate comprises an annular plate, a central vertical annular wall defining a vertical opening, and an upper peripherally beveled surface; and wherein said clamping means comprises an outwardly threaded disk having a central annular wall defining a vertical central opening, a downwardly depending peripheral lip having an inner beveled surface adapted to meet the upper beveled surface of said mounting plate in abutting relationship; said plate having lower recesses adapted to receive said stripper unit securing pads.

* * * * *